US005971084A

United States Patent [19]

Dietzen

[11] Patent Number: 5,971,084

[45] Date of Patent: Oct. 26, 1999

[54] CUTTINGS TANK APPARATUS

[75] Inventor: Gary H. Dietzen, Lafayette, La.

[73] Assignee: M-I L.L.C., Houston, Tex.

[21] Appl. No.: 09/071,820

[22] Filed: May 1, 1998

Related U.S. Application Data

[63] Continuation-in-part of application No. 09/039,178, Mar. 13, 1998, which is a continuation-in-part of application No. 08/950,296, Oct. 14, 1997, which is a continuation-in-part of application No. 08/813,462, Mar. 10, 1997, which is a continuation-in-part of application No. 08/729,872, Oct. 15, 1996, which is a continuation-in-part of application No. 08/416,181, Apr. 4, 1995, Pat. No. 5,564,509, which is a continuation-in-part of application No. 08/197,727, Feb. 17, 1994, Pat. No. 5,402,857.

[51] Int. Cl.[6] ..... E21B 7/00

[52] U.S. Cl. ..... 175/66; 175/207; 414/409

[58] Field of Search ..... 175/66, 206, 207; 405/128; 134/108; 414/409, 410, 422

[56] References Cited

U.S. PATENT DOCUMENTS

| | | | |
|---|---|---|---|
| 3,907,147 | 9/1975 | Goobeck | 220/1.5 |
| 4,116,288 | 9/1978 | Love | 175/66 |
| 4,444,277 | 4/1984 | Lewis | 175/66 |
| 4,498,584 | 2/1985 | Newbury | 206/510 |
| 5,425,188 | 6/1995 | Rinker | 175/66 |
| 5,725,021 | 3/1998 | Dallas | 175/66 X |

*Primary Examiner*—Frank Tsay
*Attorney, Agent, or Firm*—Garvey, Smith, Nehrbass & Doody, L.L.C.

[57] ABSTRACT

An oil well cuttings disposal tank apparatus of improved construction provides a tank body having an interior and a plurality of side walls, a plurality of end walls, a bottom wall, and a top wall with a discharge opening at one end portion thereof. The discharge opening communicates with the intersection of the top wall and one of the end walls. A hatch is provided for opening and closing the discharge opening. A plurality of lifting plates are attached to the side walls and extend upwardly from the top wall, each of the lifting plates having openings or eyelets for attaching lifting lines thereto. A stacking beam is associated with each lifting plate, each stacking beam extending from the top wall upwardly a distance and attaching to the lifting plate at a position above the top wall. Each stacking beam has a load bearing surface that extends laterally from its lifting plate inwardly toward an opposite stacking beam and the central portion of the tank. A pair of slots on the lower end portion of the tank body at the bottom wall are provided, the slots being shaped to conform to and nest upon the bearing surfaces of the stacking beams when one tank body is nested upon another similarly configured tank body. Upper portions of the lifting plates prevents sliding of one tank relative to the other tank in a "X" direction. The connection between stacking beams and lateral slots prevent sliding of one tank stacked upon another tank in a "Y" direction.

20 Claims, 6 Drawing Sheets

CUTTINGS TANK APPARATUS

CROSS-REFERENCE TO RELATED APPLICATIONS

This is a continuation-in-part of U.S. patent application Ser. No. 09/039,178, filed Mar. 13, 1998, which is a continuation-in-part of U.S. patent application Ser. No. 08/950,296, filed Oct. 14, 1997, which is a continuation-in-part of U.S. patent application Ser. No. 08/813,462, filed Mar. 10, 1997 which is a continuation-in-part of U.S. patent application Ser. No. 08/729,872, filed Oct. 15, 1996, which is a continuation-in-part of U.S. patent application Ser. No. 08/416,181, filed Apr. 4, 1995 (now U.S. Pat. No. 5,564,509) which is a continuation-in-part of U.S. patent application Ser. No. 08/197,727, filed Feb. 17, 1994 (now U.S. Pat. No. 5,402,857), each of which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the disposal of the cuttings from oil and gas well drilling, and more particularly to an improved method and apparatus for the disposal of cuttings generated during drilling of an oil and gas well. More particularly, the present invention relates to an improved cuttings tank apparatus useful in the disposal of cuttings generated during the drilling of an oil and gas well wherein an improved configuration enhances the storage of cuttings at a well drilling site or rig with limited space and also facilitates quick emptying of the tank at a selected approved disposal site.

2. General Background of the Invention

In the drilling of oil and gas wells, a drill bit is used to dig many thousands of feet into the earth's crust. Oil rigs typically employ a derrick that extends above the well drilling platform and which can support joint after joint of drill pipe connected end to end during the drilling operation. As the drill bit is pushed farther and farther into the earth, additional pipe joints are added to the ever lengthening "string" or "drill string". The drill pipe or drill string thus comprises a plurality of joints of pipe, each of which has an internal, longitudinally extending bore for carrying fluid drilling mud from the well drilling platform through the drill string and to a drill bit supported at the lower or distal end of the drill string.

Drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the surface, it is contaminated with small pieces of shale and rock which are known in the industry as well cuttings or drill cuttings.

Well cuttings have in the past been separated from the reusable drilling mud with commercially available separators that are know as "shale shakers". Some shale shakers are designed to filter coarse material from the drilling mud while other shale shakers are designed to remove finer particles from the well drilling mud. After separating well cuttings therefrom, the drilling mud is returned to a mud pit where it can be supplemented and/or treated prior to transmission back into the well bore via the drill string and to the drill bit to repeat the process.

The disposal of the separated shale and cuttings is a complex environmental problem. Drill cuttings contain not only the mud product which would contaminate the surrounding environment, but also can contain oil that is particularly hazardous to the environment, especially when drilling in a marine environment.

In the Gulf of Mexico for example, there are hundreds of drilling platforms that drill for oil and gas by drilling into the subsea floor. These drilling platforms can be in many hundreds of feet of water. In such a marine environment, the water is typically crystal clear and filled with marine life that cannot tolerate the disposal of drill cuttings waste such as that containing a combination of shale, drilling mud, oil, and the like. Therefore, there is a need for a simple, yet workable solution to the problem of disposing of oil and gas well cuttings in an offshore marine environment and in other fragile environments where oil and gas well drilling occurs.

Traditional methods of cuttings disposal have been dumping, bucket transport, cumbersome conveyor belts, and washing techniques that require large amounts of water. Adding water creates additional problems of added volume and bulk, messiness, and transport problems. Installing conveyors requires major modification to the rig area and involves many installation hours and very high cost.

Safeguard Disposal Systems, Inc. of Lafayette, La. has manufactured, sold, and used publicly a cuttings disposal tank that includes hatch openings into which oil well cuttings can be placed. These prior art tanks also have attachments for enabling lift lines to be affixed to the tank so that it can be transported to and from offshore platforms and emptied when full. Further examples of these tanks are shown in one or more of the following U.S. Pat. Nos.: 5,564,509; 5,402,857; Des. 337,809; and Des. 296,027. U.S. Pat. Nos. 5,564,509 and 5,402,857 are incorporated herein by reference.

BRIEF SUMMARY OF THE INVENTION

The present invention provides an improved construction for a cuttings disposal tank that improves upon the designs shown in the above-discussed prior art patents.

The present invention provides an improved oil well cuttings disposal tank apparatus that has a tank body with an interior, a plurality of side walls, a plurality of end walls, a bottom wall, and a top wall with a discharge opening at one end portion thereof.

The discharge opening communicates with the inner section of the top wall and one of the end walls.

A hatch is provided for opening and closing the discharge opening.

A plurality of lifting plates are attached to the side walls and extend upwardly to a position above the top wall.

Each of the lifting plates provides attachments for affixing lift lines or shackles thereto. This enables the tank to be lifted and manipulated with a crane and slings that extend from the crane or cranes to the top of the lifting plates at the attachments. These attachments can be in the form of openings through which shackles or other lifting implements can be affixed.

A stacking beam is provided with each lifting eye. Each stacking beam if preferably a "ell" shaped member that extends from the top wall upwardly a distance and then attaches to the lifting plate at a position above the top wall.

Each stacking beam provides a load bearing surface that extends laterally from the associated lifting plate inwardly toward the opposite stacking beam and the central portion of the tank. Each opposed stacking beam provides a load bearing surface that is in the same plane with the opposite load bearing surface. This enables the stacking beams to provide aligned load bearing surfaces that receive a pair of slots provided on the lower end portion of another similarly configured tank at the bottom wall.

Since each tank provides the pair of transverse slots on the lower end portion of the tank body, each slot conforms to and nests upon the bearing surfaces of a stacking beam when one tank body is nested upon another similarly configured tank body.

This configuration has great utility in offshore oil and gas well drilling operations, because it enables tanks to be stacked one upon the other when space is at a premium such as, for example, in the offshore oil and gas well drilling industry. The deck space on the offshore oil rigs is very limited because of the huge amount of equipment that must be stored on these rigs and the huge expense of constructing them which necessarily minimizes the amount of space that can be provided.

The slots are U-shaped so that they conform to the top of each stacking beam thus providing an interlocking arrangement that prevents lateral movement of an upper tank relative to a lower tank such as can occur when these tanks are being transported to or from a drill site on a work boat for example.

Each stacking beam preferably includes a vertical beam section and a horizontal beam section. The horizontal beam section spans between the vertical beam section and its lifting plate. It is the horizontal beam section that occupies the transverse slot at the lower end portion at each tank so that one tank does not move laterally with respect to another. Additionally, the lifting plates extend above the stacking beams a short distance to provide a means for preventing a sliding of an upper tank relative to a lower tank in a direction that is at ninety (90°) with respect to the sliding that would be constrained by the stacking beams. This construction prevents sliding of one tank relative to the tank that it is stacked upon in both "X" and "Y" axial directions. Such a stacking arrangement is important with the apparatus of the present invention because of its utility in the marine oil and gas well drilling industry that typically requires transport by marine vessels.

A lifting gusset is provided at the bottom wall and at an end wall that is opposite the tank discharge opening. This gusset plate enables a lift line, such as a crane line or fast line, to be attached to the tank body at the gusset. This helps in emptying the tank to an improved discharge site such as a disposal barge.

The discharge opening is provided with a means for preventing the accumulation of cuttings at the opening during an emptying of the tank. A plurality of plate members can be mounted on the inside of the tank body at the opening, the plates being configured to prevent the accumulation of cuttings at the tank top wall and side walls adjacent to the opening. The plates are preferably inclined members that extend between the side walls of the tank next to the opening and the opening itself.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
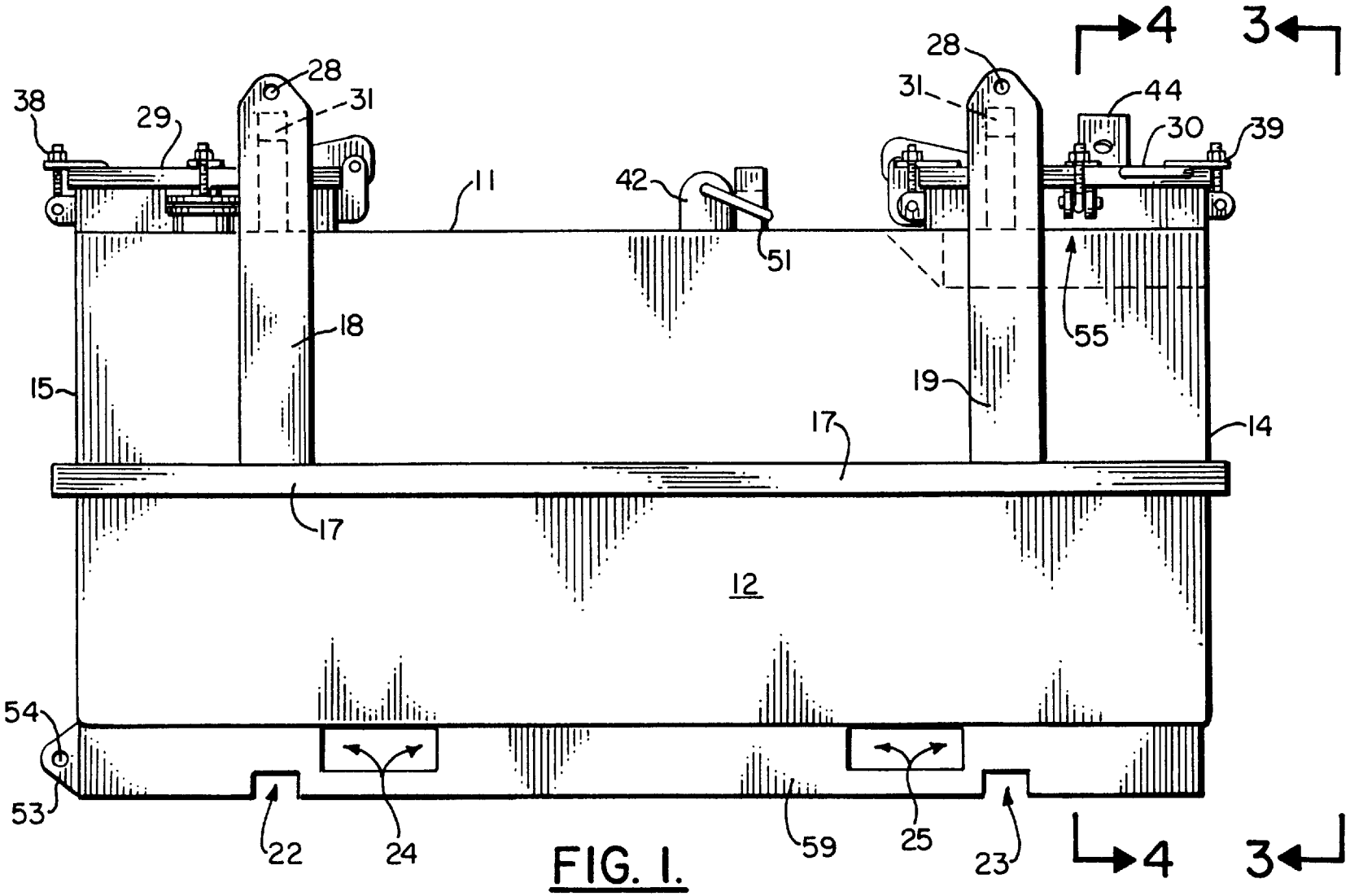
FIG. 1 is an elevational view of the preferred embodiment of the apparatus of the present invention.

FIGS. 1–4 show generally the preferred embodiment of the apparatus of the present invention designated generally by the numeral 10. Cuttings tank apparatus 10 is formed of a plurality of walls that are connected at their edge portions by welding for example. Tank apparatus 10 includes a top wall 11, a pair of side walls 12, 13, a pair of end walls 14, 15, and a bottom wall 16.

A horizontal beam 17 extends around the periphery of tank 10 being positioned about midway in between top wall 11 and bottom wall 16. Horizontal beam 17 extends around each of the side walls 12, 13 and each of the end walls 14, 15. Peripheral floor beams 59, 60 can be provided at the periphery of bottom wall 16.

A plurality of vertical lifting plates 18, 19, 20, 21 extend upwardly from the horizontal beam 17 to a position slightly above tank top wall 11. The lifting plates 18, 19, 20, 21 are welded to side walls 12, 13 and to horizontal beam 17. Each of the vertical lifting plates 18, 19, 20, 21 provides an eyelet 28 for attaching a shackle or other lifting implement to the vertical lifting plates 18, 19, 20, 21. This enables the tank 10 to be manipulated with a crane 80 or other lifting apparatus during an emptying of the tank of cuttings as occurs when the tank is shipped from a drilling location to a selected disposal site such as a barge (see FIGS. 11–13).

Figure 3:
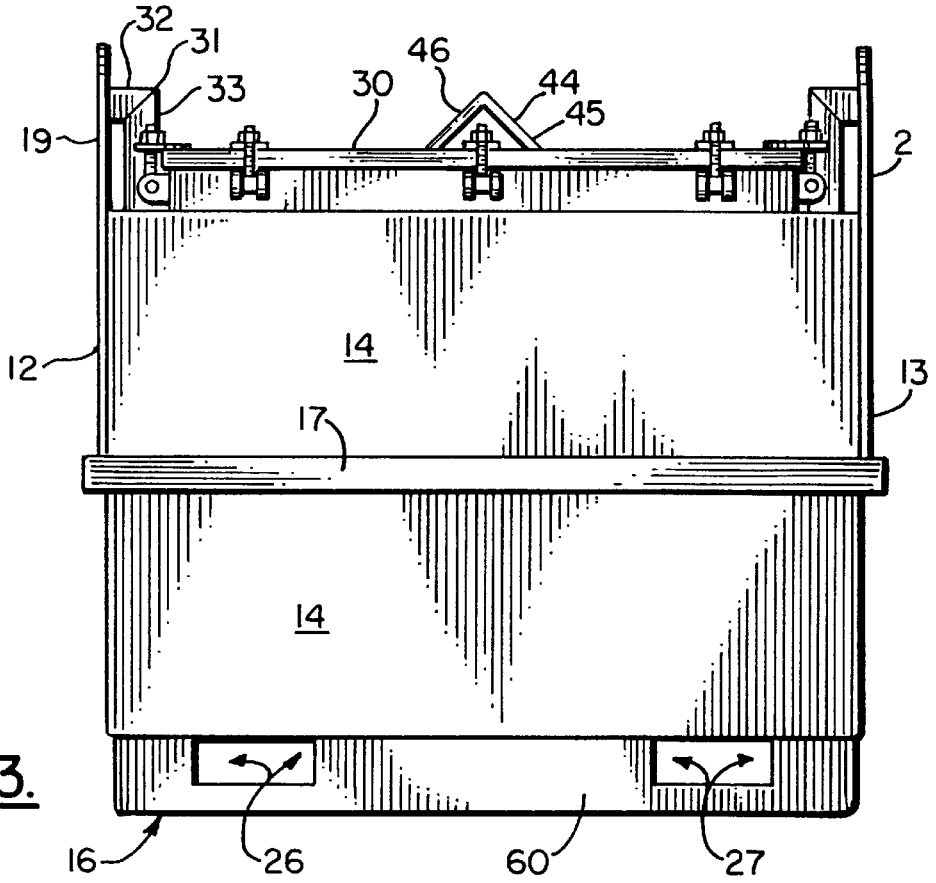
FIG. 3 is an end view of the preferred embodiment of the apparatus of the present invention taken along lines 3—3 of FIG. 1.
Figure 4:
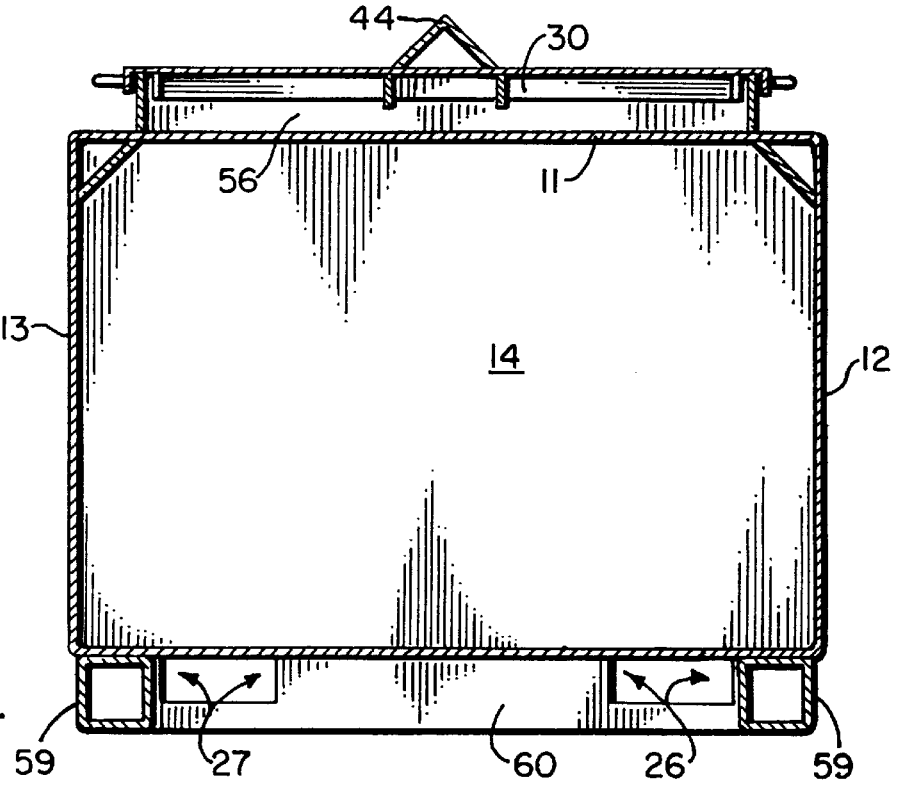
FIG. 4 is a sectional view taken along lines 4—4 of FIG. 1.

In some situations, it is desirable to transport tank 10 using a forklift. A plurality of horizontal channels are provided that enable a forklift to engage and support tank 10 during transport in the proximity of a drill site or on a drill rig. In FIG. 1, a pair of horizontal channels 24, 25 extend from side wall 12 to side wall 13. In FIG. 3, a pair of horizontal channels 26, 27 extend between end wall 14 and the end wall 15.

Figure 2:
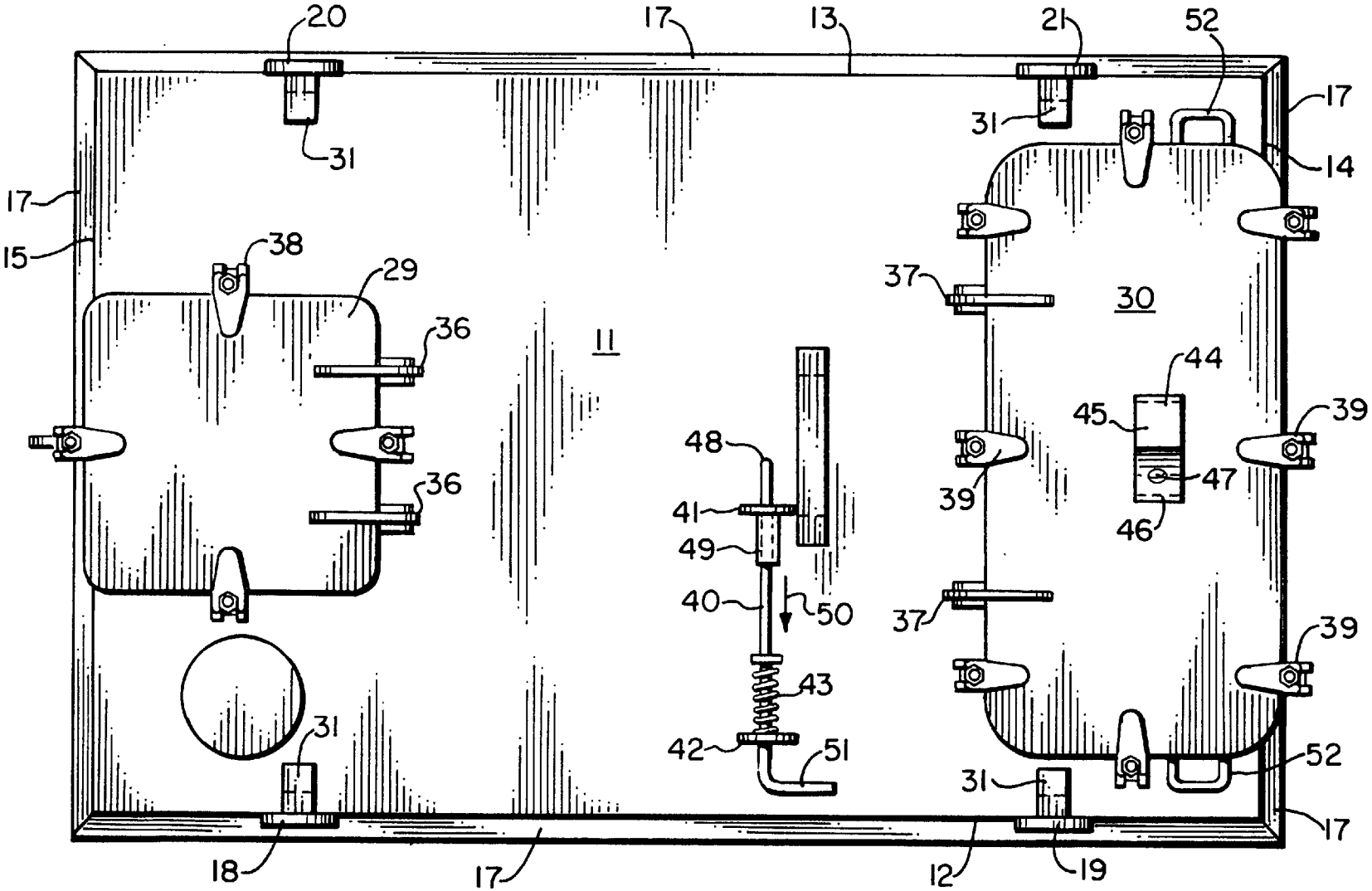
FIG. 2 is a top view of the preferred embodiment of the apparatus of the present invention.
Figure 6:
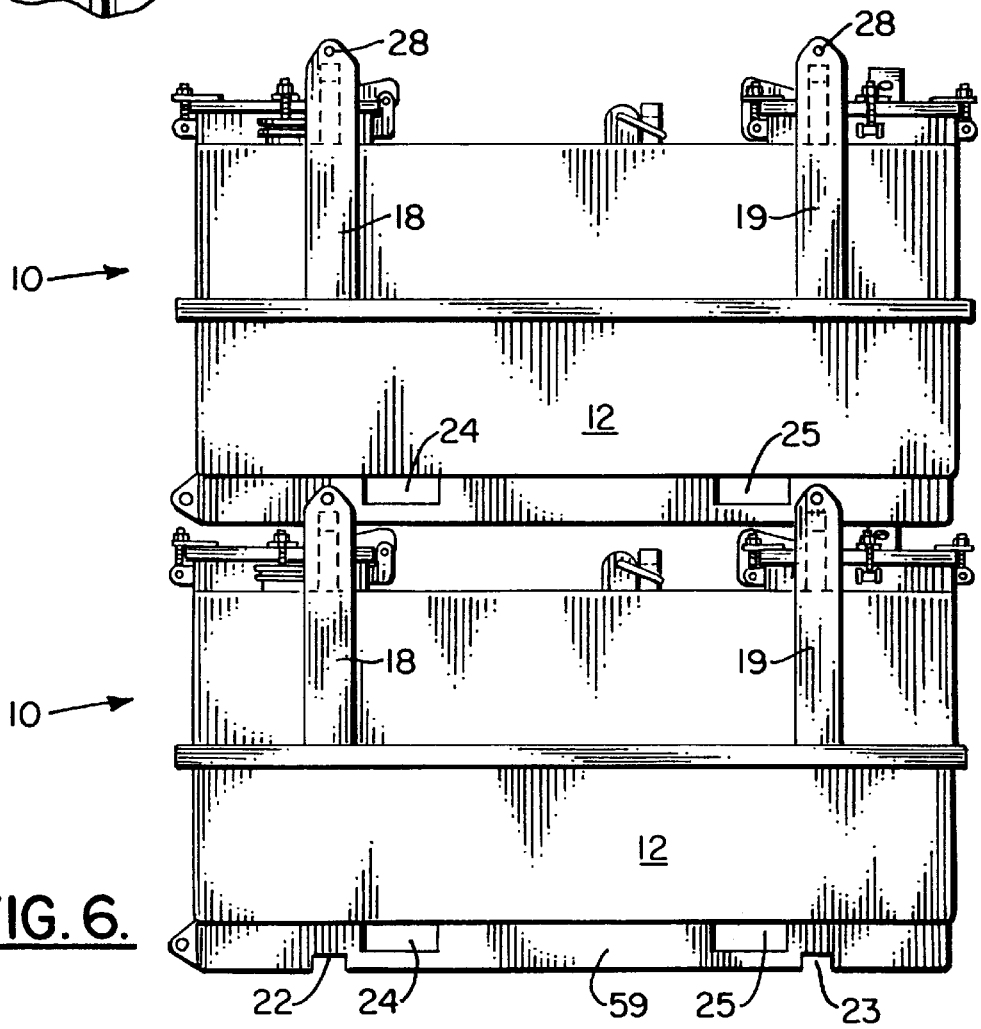
FIG. 6 is an elevational view of the preferred embodiment of the apparatus of the present invention illustrating a stacking arrangement of two of the tanks.

In order to stack one tank 10 upon another tank 10 as shown in FIG. 6, an improved stacking arrangement is provided as shown in the drawings. This stacking arrangement includes transverse slots 22, 23 that extend from side wall 12 to side wall 13 at bottom wall 16. A plurality of stacking beams 31 are provided near top wall 11 as shown in FIGS. 1–3.

Each of these stacking beams 31 includes a horizontal section 32 and a vertical section 33. During a stacking of one tank 10 upon another tank 10, the transverse slots 22, 23 in floor beams 59 near the bottom plate 16 of a tank 10 register upon the stacking beams 31 of another tank 10. This stacking arrangement can best be seen in FIGS. 5 and 6.

Figure 5:
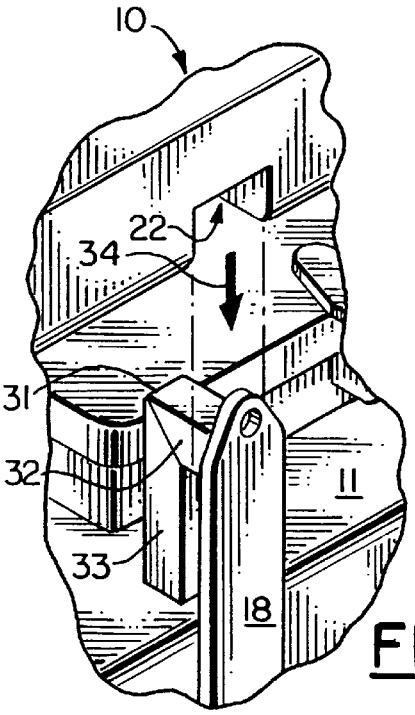
FIG. 5 is a partial perspective view of the preferred embodiment of the apparatus of the present invention illustrating the stacking arrangement between two tanks that are stacked one on top the other.

In FIG. 5, one of the transverse slots 22 is shown as a tank 10 is being lowered in the direction of arrow 34. As the upper tank 10 in FIG. 5 is lowered in the direction of arrow 34, the slot 22 registers upon and conforms to the shape of the horizontal beam 32 portion of stacking beam 31. In FIG. 6, the upper tank 10 is shown in position upon the lower tank 10 with a plurality of stacking beams 31 registering with the slots 22, 23 of the upper tank 10.

Tank 10 has a pair of hatches 29, 30. These hatches 29, 30 include a smaller hatch 29 and a larger hatch 30. The smaller hatch 29 functions as an inspection opening that enables a technician to open the hatch 29 and view the interior 35 of tank 10. Hatch 29 is pivotally attached to the top wall 11 of tank 10 using hinges 36. Similarly, a larger hatch 30 is pivotally attached to the top 11 of tank 10 with hinges 37. A plurality of latch bolts 38 can be used to lock hatch 29 in the closed position such as during transport. A plurality of latch bolts 39 can be used to lock the hatch 30 in a closed position such as during transport.

The hatch 30 has a locking pin for automatically locking the hatch 30 in an open position when the hatch 30 is opened. In FIG. 2, the pin 40 is shown mounted to support brackets 41, 42 that are welded to top wall 11. Spring 43 urges the pin 40 into an engaged position. Triangular latch 44 includes a pair of angled plates 45, 46 that are angularly oriented (e.g., forty-five (45°) degrees) with respect to hatch 30 as shown in FIGS. 2 and 3. The plate 46 has an opening 47 that receives an end portion 48 of locking pin 40.

When the hatch 30 is opened, the triangular plate 46 strikes the end portion 48 of pin 40 moving it in the direction of arrow 50. End portion 48 of pin 40 then automatically registers in opening 47 so that the pin 40 end portion 48 occupies the opening 47 until a user releases the pin 40 by pulling on handle 51. Hatch 30 can be provided with one or more handles 52 that enables a user to pivot the hatch between open and closed positions.

Figure 14:
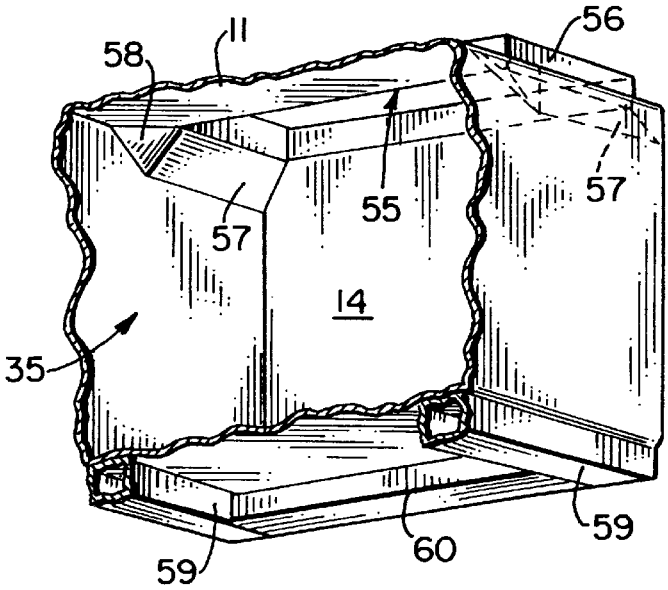
FIG. 14 is a fragmentary perspective view of the preferred embodiment of the apparatus of the present invention illustrating the outlet structure next to the large outlet hatch.
Figure 12:
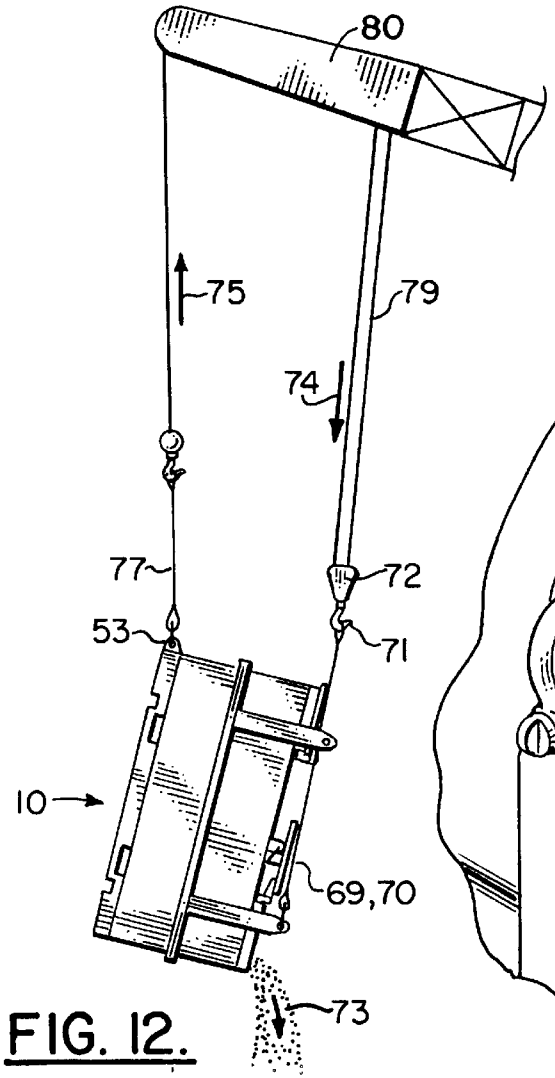
FIG. 12 is a schematic elevational view of the preferred embodiment of the apparatus of the present invention illustrating an emptying of the tank using a crane.

A large tank opening 55 is provided in top wall 11 of tank 10 at hatch 30. The tank opening 55 is surrounded by a peripheral wall 56 upon which hatch 30 rests when it is in a closed position. Below opening 55, a plurality of plates 57, 58 are provided that enhance full emptying of tank 10 interior 35 when the tank is supported by a crane 80 or forklift and inclined as shown in FIG. 12. In FIG. 14, diagonal plate 57 extends from end wall 14 along each of the tank side walls 12, 13 and along the full dimension of opening 55. The diagonal plate 57 prevents material from accumulating within the tank interior 35 at opening 55. Similarly, triangular plate 58 extends from diagonal plate 57 to a tank side wall 12 or 13 and the tank top wall 11.

A plurality of peripheral beams 59, 60 can be provided at the bottom wall 16 for reinforcing the lower portion of tank 10 adding structural integrity to the tank that is needed during manipulating by a forklift or crane.

Figure 13:
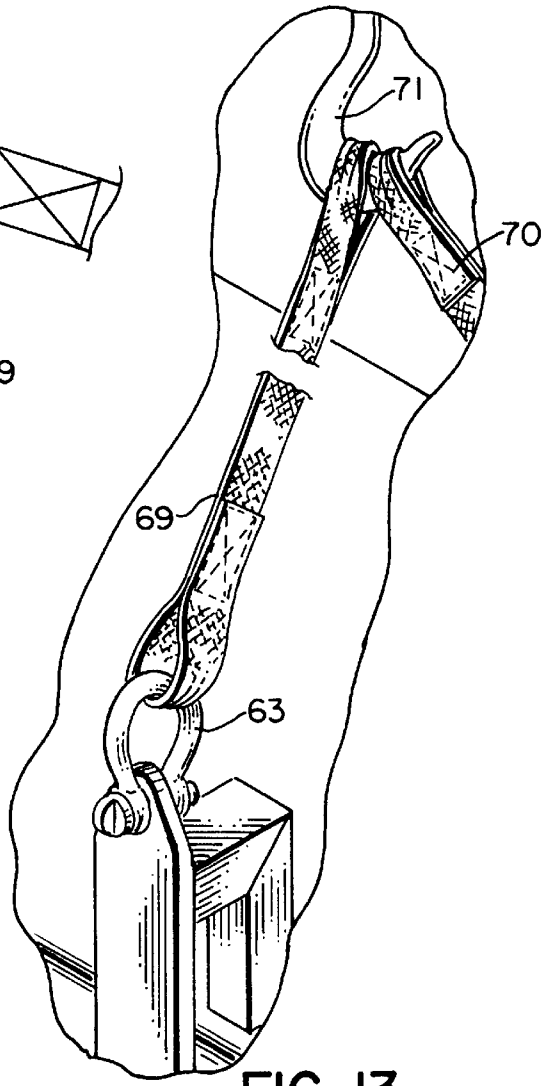
FIG. 13 is a fragmentary perspective view of the preferred embodiment of the apparatus of the present invention illustrating the connection formed between each listing plate and the crane using slings.

Padeye 53 having opening 54 is positioned at end wall 15 opposite opening 55 and hatch 30, as shown in FIG. 1. This enables crane 80 to lift the end of tank 10 next to end wall 15 using padeye 53 and its opening 54. This arrangement can thus be seen in FIGS. 11–13. In FIG. 13, shackles 68 can be placed in the eyelet 28 of each of the four vertical lifting plates 18, 19, 20, 21. A sling 69 can then be rigged from each shackle 68 to a crane lifting hook 70 or crown block 72 (see FIGS. 11–12). The crown block 72 or lifting hook 70 of the crane can also be rigged to only those two vertical lifting plates 19, 21 next to hatch 30 and opening 55 (see FIG. 11).

Figure 11:
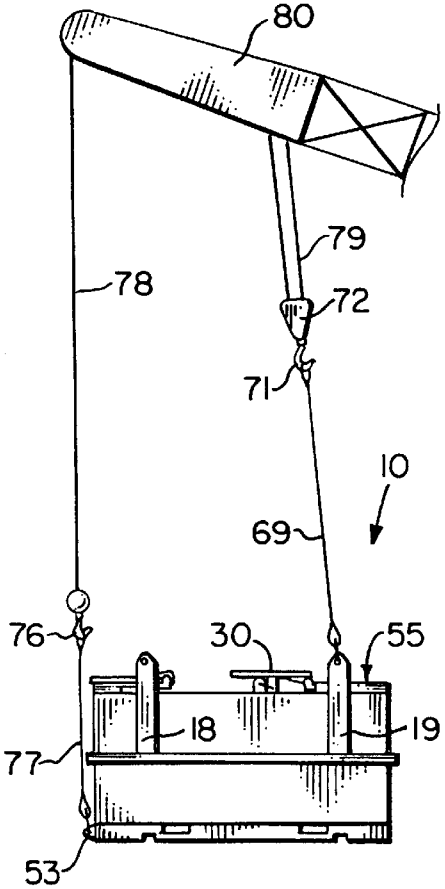
FIG. 11 is a schematic elevational view of the preferred embodiment of the apparatus of the present invention showing initial connection formed between a crane and the tank prior to the emptying of the tank.

In FIGS. 11 and 12, the crane boom 11 is shown having a heavy lift line 79 and a fast line 78. A sling 77 forms a connection between padeye 53 and fast line 78 at its hook 76. In order to empty tank 10, the crane operator raises the fast line 78 as shown by arrow 75 in FIG. 12. At same time, the crane operator can lower the heavy lift line 79 in the direction of arrow 74 as shown in FIG. 12. With the hatch 30 in an open position, this creates a discharge of the contents 73 of tank 10 into a receptacle (e.g., barge) as shown in FIG. 12.

The apparatus 10 of the present invention can be used as a collections tank for collecting cuttings that are vacuumed during drilling operations as part of a vacuum system such as the one shown and described in U.S. Pat. Nos. 5,564,509 and 5,402,857, each of which is incorporated herein by reference.

Figure 7:
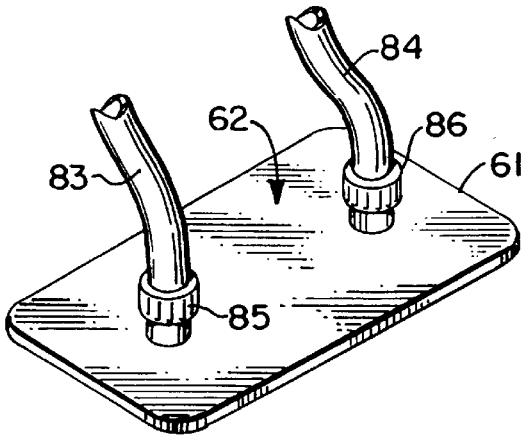
FIG. 7 is a fragmentary perspective view of the preferred embodiment of the apparatus of the present invention illustrating the vacuum cover portion thereof.
Figure 8:
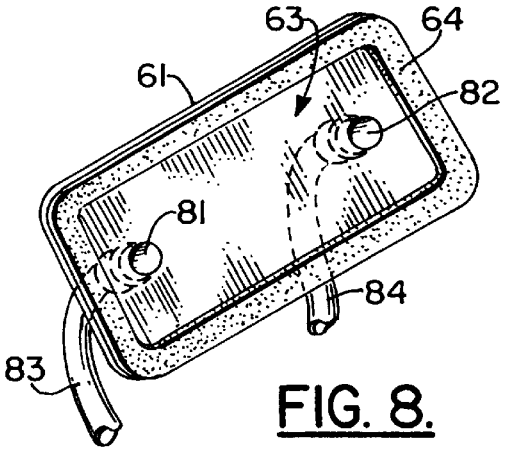
FIG. 8 is another fragmentary perspective view of the preferred embodiment of the apparatus of the present invention illustrating the vacuum cover portion thereof.
Figure 9:
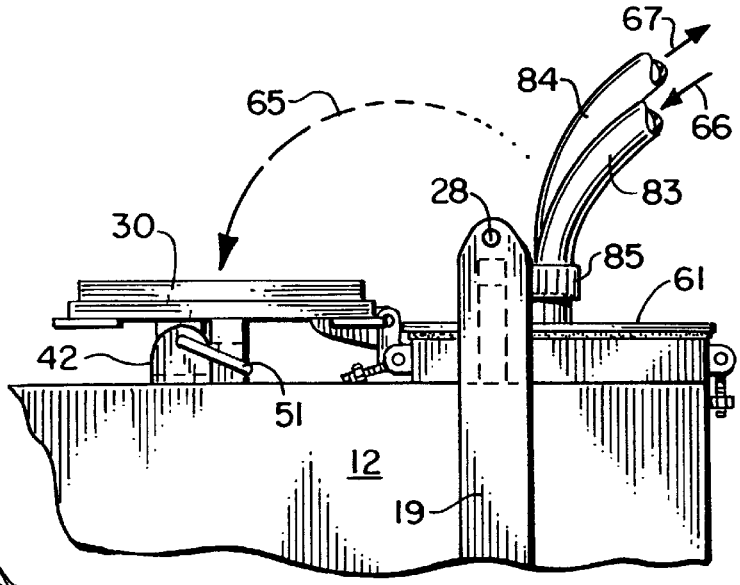
FIG. 9 is a fragmentary elevational view of the preferred embodiment of the apparatus of the present invention illustrating placement of the vacuum cover on the tank in operating position with the hatch in an open position.
Figure 10:
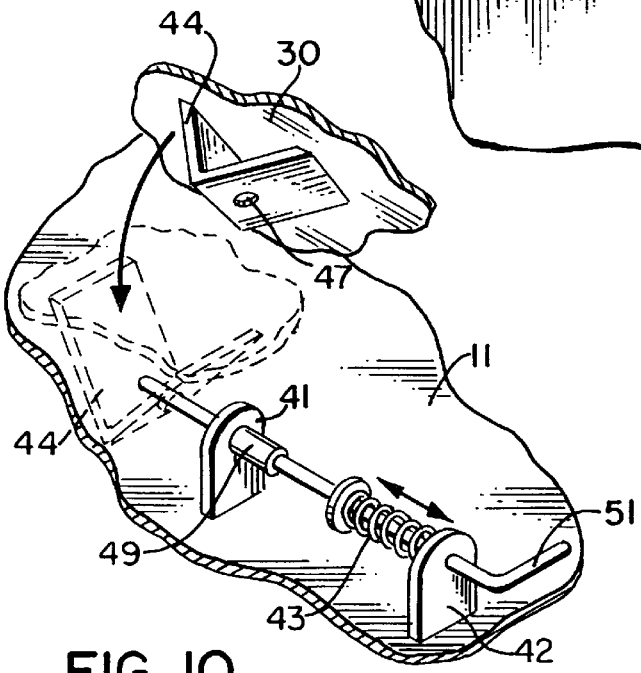
FIG. 10 is a fragmentary perspective view of the preferred embodiment of the apparatus of the present invention illustrating the hatch locking arrangement.

In FIGS. 7–9, latch 30 is opened as shown by arrow 65 in FIG. 9, and secured in an open position with pin 40. Vacuum plate 61 is then placed on opening 55 when cuttings are being vacuumed. In such a situation, cuttings flow via a first inlet suction line 83 to tank 10 interior as shown by arrow 66 in FIG. 9. Line 83 affixes to an opening or port 81 in plate 61 using fitting 85 as shown in FIGS. 7 and 8. Similarly, a second vacuum line 84 pulls a vacuum from a blower (not shown) as indicated by arrow 67 in FIG. 9.

The following table lists the parts numbers and parts descriptions as used herein and in the drawings attached hereto.

PARTS LIST

| Part Number | Description |
|---|---|
| 10 | cuttings tank apparatus |
| 11 | top wall |
| 12 | side wall |
| 13 | side wall |

-continued

PARTS LIST

| Part Number | Description |
|---|---|
| 14 | end wall |
| 15 | end wall |
| 16 | bottom wall |
| 17 | horizontal beam |
| 18 | vertical lifting plate |
| 19 | vertical lifting plate |
| 20 | vertical lifting plate |
| 21 | vertical lifting plate |
| 22 | transverse slot |
| 23 | transverse slot |
| 24 | horizontal channel |
| 25 | horizontal channel |
| 26 | horizontal channel |
| 27 | horizontal channel |
| 28 | eyelet |
| 29 | hatch |
| 30 | hatch |
| 31 | stacking beam |
| 32 | horizontal section |
| 33 | vertical section |
| 34 | arrow |
| 35 | inside |
| 36 | hinge |
| 37 | hinge |
| 38 | locking latch bolt |
| 39 | locking latch bolt |
| 40 | locking pin |
| 41 | support bracket |
| 42 | support bracket |
| 43 | spring |
| 44 | triangular latch |
| 45 | plate |
| 46 | plate |
| 47 | opening |
| 48 | end portion |
| 49 | sleeve |
| 50 | arrow |
| 51 | handle |
| 52 | handle |
| 53 | padeye |
| 54 | opening |
| 55 | tank opening |
| 56 | peripheral wall |
| 57 | diagonal plate |
| 58 | triangular plate |
| 59 | peripheral beam |
| 60 | peripheral beam |
| 61 | vacuum plate |
| 62 | top surface |
| 63 | bottom surface |
| 64 | peripheral seal |
| 65 | arrow |
| 66 | arrow |
| 67 | arrow |
| 68 | shackles |
| 69 | sling |
| 70 | sling |
| 71 | hook |
| 72 | block |
| 73 | contents |
| 74 | arrow |
| 75 | arrow |
| 76 | hook |
| 77 | sling |
| 78 | fast line |
| 79 | heavy lift line |
| 80 | crane |
| 81 | port |
| 82 | port |
| 83 | flow line |
| 84 | flow line |
| 85 | fitting |
| 86 | fitting |

The foregoing embodiments are presented by way of example only; the scope of the present invention is to be limited only by the following claims.

I claim:

1. An oil well cuttings disposal tank apparatus comprising:

a) a tank body having an interior, a plurality of sidewalls, a plurality of end walls, a bottom wall, and a top wall with a discharge opening at one end portion thereof;

b) the discharge opening communicating with the intersection of the top wall and one of the end walls;

c) a hatch for opening and closing the discharge opening;

d) a plurality of lifting plates attached to the sidewalls and extending above the top wall, each of the lifting plates having means for attaching lifting lines thereto;

e) a stacking beam associated with each lifting plate, each stacking beam extending from the top wall upwardly a distance and attaching to the lifting plate at a position above the top wall;

f) each stacking beam providing a load bearing surface that extends laterally from lifting plate inwardly toward an opposite stacking beam; and g) a pair of lateral slots on the lower end portion of the tank body at the bottom wall, each slot being shaped to conform to and nest upon the bearing surface of a stacking beam when one tank body is nested upon another similarly configured tank body.

2. The oil well cuttings disposal tank apparatus of claim 1 wherein each stacking beam includes a vertical beam section and a horizontal beam section that spans between the vertical beam section and its lifting plate.

3. The oil well cuttings disposal tank apparatus of claim 1 wherein each stacking beam is spaced from the lifting plate to which it is attached along a majority of its length.

4. The oil well cuttings disposal tank apparatus of claim 1 further comprising a horizontal beam that extends around the periphery of the tank body at a position in between the top wall and the bottom wall.

5. The oil well cuttings disposal tank apparatus of claim 4 wherein each lifting plate has a lower end portion that is attached to the horizontal beam.

6. The oil well cuttings disposal tank apparatus of claim 1 wherein each lifting plate comprises a lower section that is attached to a tank sidewall and an upper section that extends upwardly from the lower section and above the top wall, and each stacking beam affixes to the upper section of a lifting plate.

7. The oil well cuttings disposal tank apparatus of claim 1 wherein there are a plurality of floor beams extending from the bottom wall at the periphery of the tank bottom wall.

8. The oil well cuttings disposal tank apparatus of claim 7 wherein there is a floor beam at the bottom of each side wall and each end wall.

9. The oil well cuttings disposal tank apparatus of claim 1 further comprising a latch mechanism at the center of the tank top wall for holding the hatch in an open position.

10. An oil well cuttings disposal tank apparatus comprising:

a) a tank body having an interior, a plurality of sidewalls, a plurality of end walls, a bottom wall and a top wall with a discharge opening at one end portion thereof;

b) the opening communicating with the intersection of the top wall and one of the end walls;

c) a hatch for opening and closing the opening;

d) a plurality of lifting plates attached to the sidewalls and extending above the top wall plurality of the lifting plates having attachments that enable lifting lines to be attached to the lifting plates;

e) a stacking beam connected to the top wall and a lifting eye;

f) each stacking beam providing a load bearing surface that extends from a lifting plate inwardly toward the central portion of the tank body;

g) a pair of slots on the lower end portion of the tank body at the bottom wall, each slot being shaped to nest upon the bearing surface of a stacking beam when one tank body is nested upon another similarly configured tank body; and h) a lifting gusset positioned at the bottom wall and an end wall that is opposite the tank opening, the gusset providing a line attachment for enabling a lift line to be attached to the tank body at the gusset.

11. The oil well cuttings disposal tank apparatus of claim 10 further comprising a second tank opening next to one of the end walls that is opposite the other tank opening.

12. The oil well cuttings disposal tank apparatus of claim 10 wherein a pair of the lifting plates are positioned next to the tank opening.

13. The oil well cuttings disposal tank apparatus of claim 10 wherein each stacking beam includes a vertical beam section and a horizontal beam section that spans between the vertical beam section and a lifting plate.

14. The oil well cuttings disposal tank apparatus of claim 10 further comprising a horizontal beam that extends around the periphery of the tank body at a position in between the top wall and the bottom wall.

15. The oil well cuttings disposal tank apparatus of claim 14 wherein each lifting plate has a lower end portion that is attached to the horizontal beam.

16. The oil well cuttings disposal tank apparatus of claim 10 further comprising a locking member positioned at the central portion of the top wall that holds the hatch in open position.

17. The oil well cuttings disposal tank apparatus of claim 10 wherein there is a floor beam at the bottom of each side wall and at the bottom of each end wall.

18. The oil well cuttings disposal tank apparatus of claim 17 wherein some of the floor beams have sockets for accepting fork lift tines that enable the tank body to be lifted at the sockets.

19. The oil well cuttings disposal tank apparatus of claim 17 wherein each of the floor beams has sockets for accepting fork lift tines that enable the tank body to be lifted at the sockets.

20. An oil well cuttings disposal tank apparatus comprising:

a) a tank body having an interior, a plurality of sidewalls, a plurality of end walls, a bottom wall and a top wall with an opening at one end portion thereof;

b) the opening communicating with the intersection of the top wall and one of the end walls;

c) a hatch for opening and closing the opening;

d) a plurality of lifting plates attached to the sidewalls and extending above the top wall, a plurality of the lifting plates having attachments that enable lifting lines to be attached to the lifting plates;

e) a stacking beam connected to the top wall and a lifting eye;

f) each stacking beam providing a load bearing surface that extends from a lifting plate inwardly toward the central portion of the tank body;

g) a pair of slots on the lower end portion of the tank body at the bottom wall, each slot being shaped to nest upon the bearing surface of a stacking beam when one tank body is nested upon another similarly configured tank body; and h) a plurality of plate members mounted on the inside of the tank body at the opening and configured to prevent accumulation of cuttings at the opening during an emptying of the tank through the opening.

* * * * *